United States Patent [19]

Harbert

[11] 4,185,668

[45] Jan. 29, 1980

[54] METHOD AND MEANS FOR INSERTING, CUTTING AND BINDING SPIRAL WIRE BINDERS

[75] Inventor: Larry M. Harbert, Pontiac, Mich.

[73] Assignee: Hans Sickinger Co., Pontiac, Mich.

[21] Appl. No.: 916,160

[22] Filed: Jun. 16, 1978

[51] Int. Cl.[2] ..... B21F 11/00

[52] U.S. Cl. ..... 140/92.4; 140/92.7; 72/131; 72/132; 83/907

[58] Field of Search ..... 140/92.3, 92.4, 92.7, 140/92.94; 72/132, 131; 83/907

[56] References Cited

U.S. PATENT DOCUMENTS

| | | | |
|---|---|---|---|
| 2,135,729 | 11/1938 | Olgay | 72/132 |
| 2,808,079 | 10/1957 | Tauber | 140/92.3 |
| 3,064,693 | 11/1962 | Spuhl | 140/92.7 |
| 3,451,443 | 6/1969 | Spuhl | 140/92.3 |

*Primary Examiner*—Lowell A. Larson

*Attorney, Agent, or Firm*—Harness, Dickey & Pierce

[57] ABSTRACT

A method and apparatus for inserting and forming spiral wire binders in a manner which insures uniform cutting and crimping of the coil ends and alignment of the inbent crimps. The method comprises the steps of feeding the spiral wire into the book its full length, stopping the feeding operation for a predetermined time delay and finally severing and crimping the coil ends. The apparatus comprises means responsive to completion of the feeding operation for stopping the feed and initiating actuation of a timer, and cutting and crimping the coil ends in response to running out of the timer.

2 Claims, 3 Drawing Figures

METHOD AND MEANS FOR INSERTING, CUTTING AND BINDING SPIRAL WIRE BINDERS

BACKGROUND OF THE INVENTION

1. Field of the Invention

The invention relates to spiral wire binder applying machines of the type in which the forming and insertion of the spiral wire is closely followed by cutting and crimping or inwardly bending the coil ends.

2. Description of the Prior Art

In the past it has been conventional to feed the spiral wire binder through the aligned apertures in the group of sheets which forms the book and, upon a signal responsive to the full insertion of the binder, stopping the feed and simultaneously actuating the cutting and crimping mechanism which severs the coil ends and bends them inwardly toward each other.

During the forming and inserting operation it is possible to store energy in the coil because of the driving force in the coiling tool and friction between the coil and the holes through which they are being driven. This energy storage occurs particularly in applications where the diameter of the coil is relatively large, perhaps 20 mm or larger, and in coil binding machines having relatively high rotational mandrel speeds. The amount of energy stored in the coil could be referred to as a wind up effect, and is greatest at the moment the coiling operation ceases. At this time the coil will tend to release this energy by unwinding. The time required to release this energy is perhaps up to one second in range depending upon the diameter and length of the coil.

Previously, the spiral wire applying machines did not have means for allowing energy relief time for the coil before the cutting cycle was actuated. This caused the coil to unwind after the ends were cut and crimped. This in turn created an undesirable effect on the finished product since the inwardly bent ends were not aligned and this could cause distortion of the book itself and possibly interfere with full opening movement. Thus, the effect particularly for larger coil diameters was both unsatisfactory appearance and malfunction.

BRIEF SUMMARY OF THE INVENTION

It is an object of the present invention to provide an improved method and apparatus for overcoming this drawback of previous spiral binder applying machines and to insure that the cutting and crimping of the coil ends will be accomplished only after forming and insertion is completed and the coil has released its stored energy.

It is another object to provide an improved method and apparatus of this character which will be economical and reliable to use.

Briefly, the method of this invention comprises the steps of feeding a spiral wire binder into a book until the full length of the binder has been fed, stopping the feeding movement and at the same time initiating actuation of a timer, and cutting and inwardly crimping the opposite ends of the binder in response to running out of said timer.

The apparatus of this invention comprises, in brief, means for feeding a spiral wire binder into a book, means for sensing the completion of said insertion, means responsive to said sensing means for stopping said insertion and simultaneously initiating actuation of a timer, and means responsive to running out of said timer for causing the ends of said binder to be cut and inwardly crimped.

BRIEF DESCRIPTION OF THE DRAWINGS

FIG. 3 is a wiring diagram showing the electrical circuitry for carrying out the invention.

DESCRIPTION OF THE PREFERRED EMBODIMENT

Figure 1:
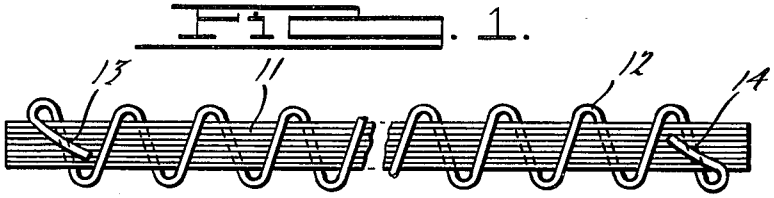
FIG. 1 is a top plan view of a book with a spiral binder mounted therein showing the preferred position of the crimped ends.

A book or other group of sheets is indicated at 11 in FIG. 1 and this figure shows a spiral wire binder 12 passing through the book and having inwardly crimped ends 13 and 14. The present invention has as an object to insure that the spiral wire binder 12, when it rests in the book edge will not distort the book by having tension or torsion stored therein, and also to insure that the inwardly bent crimped ends 13 and 14 are substantially aligned on the outside of the book spine and are not misaligned or on opposite sides of the book. This will nnot only have a satisfactory appearance but it will insure that the book is not distorted and may be swung open completely at any page without difficulty.

Figure 2:
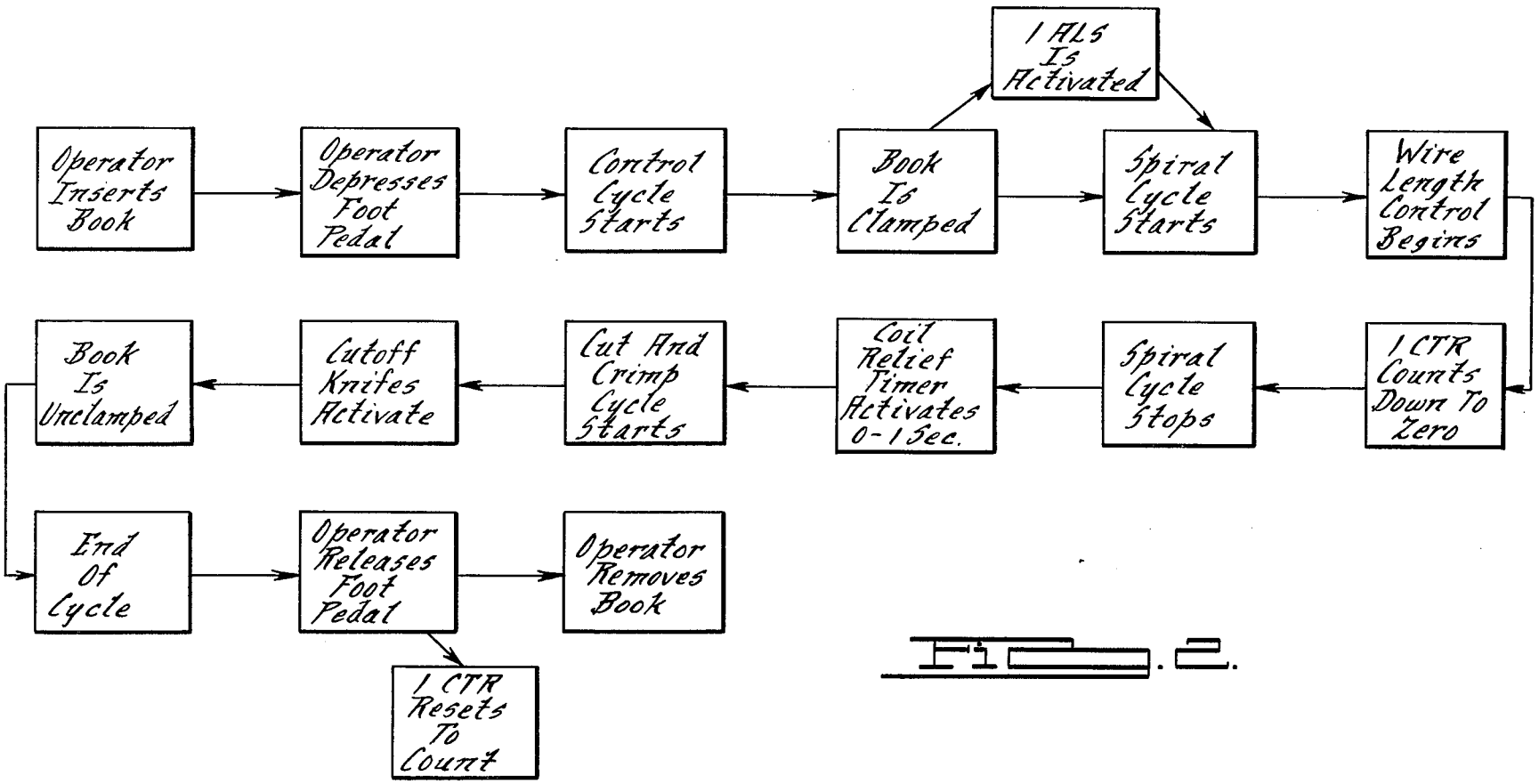
FIG. 2 is a flow diagram showing the sequence of operations of a coil binding machine incorporationg the present invention.
Figure 2:
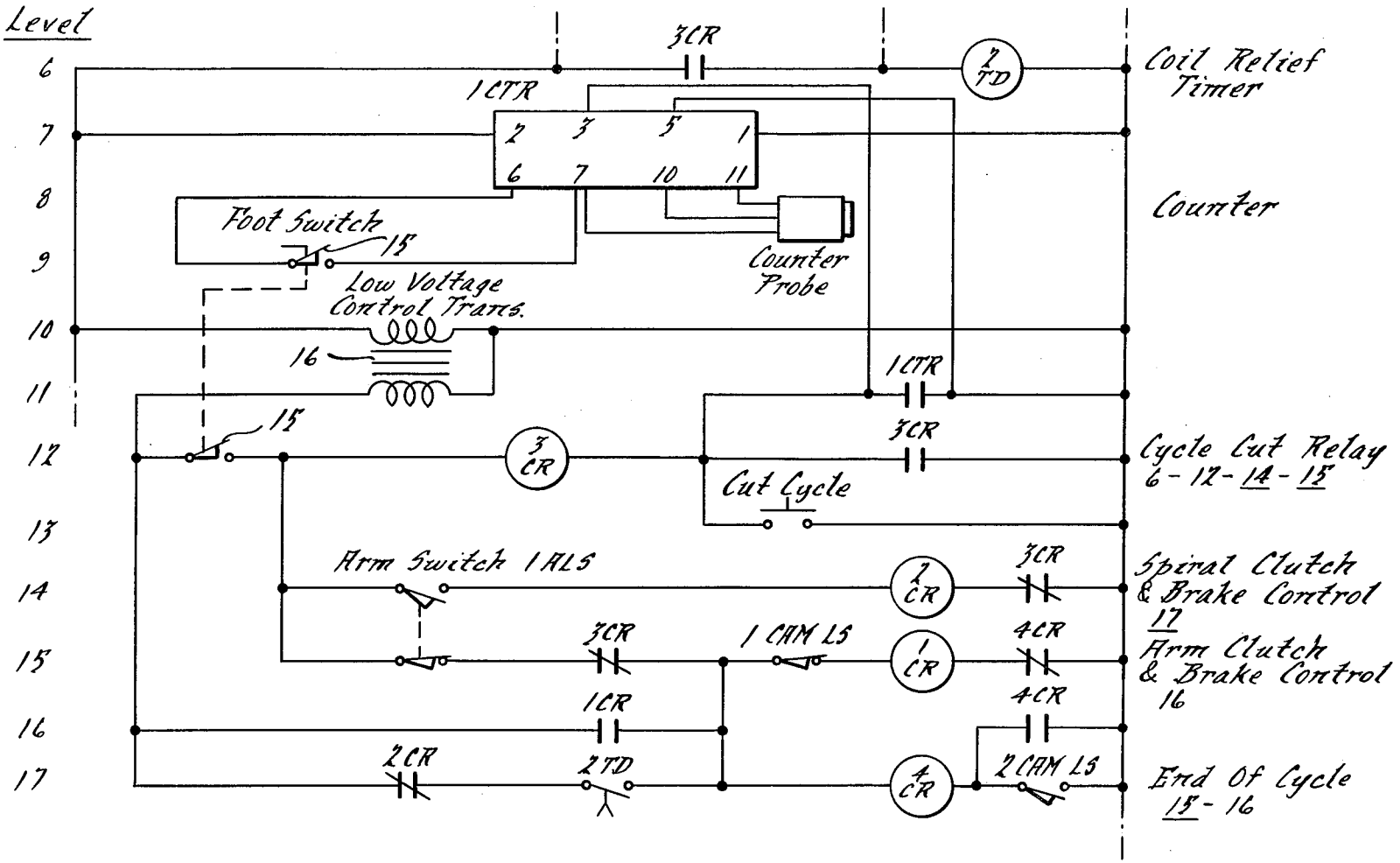

FIG. 2 shows the entire sequence of operation of a typical coil binding machine but with the coil relief timing feature of the present invention placed in this sequence. It should be noted that this sequence includes features of a coil binder operation which are not necessarily found in all coil binding machines and are not all essential to carrying out of the present invention. The sequence shown is typical for example of a coil binding machine of the type shown in U.S. Pat. No. 3,378,046, issued Apr. 16, 1968 to Claus Ostermeier. After the operator inserts an unbound but perforated book in the machine, a foot pedal is depressed which starts the control cycle. The spine of the book is clamped between two members and completion of the clamping operation actuates switch 1ALS, referred to as an "arm switch" in FIG. 3, to start the spiral wire forming and feeding cycle. At this time the controller of the wire length is activated, this being for example in the form of a counter 1CTR. When the counter reaches zero, the spiral forming cycle will stop.

In prior machines, simultaneously with stopping of the spiral cycle the cut cycle would start. As pointed out above, especially with larger diameter coils, the stored energy or wind up effect in the coil would be present at this time and therefore the cut and crimp operations would result in misaligned crimps and possibly distortion of the book.

In accordance with the invention, the stopping of the spiral cycle is not accompanied by initiation of the cut and crimp cycle. Instead, the running out of the counter activates a coil relief timer which could be set anywhere in the range of perhaps zero to one second depending on requirements. The timer is indicated at 2TD in FIG. 3. Running out of the timer will cause the cut and crimp cycle to start, activating the cut off and crimping knives. Completion of this operation will cause the book to be unclamped indicating the end of the cycle. At this point the operator will release the foot pedal and in response to this counter 1CTR will be reset. The fact that the counter is not reset until the foot pedal is released is for machine safety purposes. The operator will then remove the book.

Referring to FIG. 3, the remaining portions of the circuit may perhaps best be described in connection with the sequence of operation of the machine. Assuming an initial condition in which the operator is placing an unbound book in the machine, the operator will depress the foot pedal closing foot switch 15. This will energize contact relay 1CR, the circuit running from the left hand end of level 12 to the right hand of level 15. This will cause the clamps to close on the book by conventional means (not shown) and also close a holding contact 1CR on level 16. Closure of the clamps on the books will cause shifting of arm switch 1ALS to its raised position on levels 14 and 15. This will energize contact relay 2CR, causing the spiral forming and feeding operation to commence, again by conventional means not shown. Closure of the foot switch will also activate counter 1CTR, and its probe will count the number of revolutions of the spiral drive so as to sense the complete feeding of the spiral wire binder into the book. Contact relay 1CR will be deenergized almost immediately after it has been energized by momentary opening of switch 1CAM LS on level 15. This is in preparation for a secon energization of 1CR later in the cycle. When the counter senses complete spiral feeding it will close switch 1CTR on level 11, causing energization of contact relay 3CR on level 12. A holding contact 3CR on level 12 will close and a normally closed contact 3CR on level 14 will open, deenergizing 2CR. This will deactivate the spiral wire forming and feeding mechanism.

At the same time normally open contact 3CR on level 6 will close, activating coil relief timer 2TD. This timer may be of any suitable construction such as ATC solid state delay timer Type No. 328A20010XX. The timer may be adjusted in accordance with the needs of the operation. The timing may be anywhere from 0 to 1 second, with longer delays being needed for larger diameter coils and/or longer lengths of spiral wire binder.

After timer 2TD has run out, switch 2TD on level 17 will close. This will reenergize contact 1CR by means of a transformer 16. Relay 1CR will cause the cut off and crimping knives to be actuated by means not shown. The time delay between stopping of the spiral feed and initiation of the cutting and crimping operation will permit relaxation of the spiral wire binder.

A limit switch on level 17, 2CAM LS, will be actuated at the end of the cutting and crimping cycle by a timing shaft (not shown). This will energize contact relay 4CR, opening switch 4CR on level 15. This will cause contact relay 1CR to be deenergized for the second time in the operation and all four contact relays 1CR through 4CR will be deenergized at this time. The operator may then release the foot pedal, shifting foot switch 15 back to its previous position and permitting counter 1CTR to be reset. This will permit another cycle to be started after the operator inserts the next book.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A method comprising the steps of feeding a spiral wire binder into an edge-apertured book until the full length of the binder has been fed, the configurations of the binder and edge apertures being such that energy storage due to coil windup will tend to occur during said feeding step, providing a timer set for the time needed after feed stopping to permit unwinding of said coil and release of said stored energy, stopping the feeding movement and at the same time initiating actuation of said timer, and cutting and inwardly crimping the opposite ends of the binder in response to running out of said timer.

2. An apparatus comprising means for feeding a spiral wire binder into an edge-apertured book in a manner tending in cause energy storage due to coil windup during insertion into the apertures, means for sensing the completion of said insertion, a timer set for the time needed after feed stopping to permit unwinding of said coil and release of said stored energy, means responsive to said sensing means for stopping said insertion and simultaneously initiating actuation of said timer, and means responsive to running out of said timer for causing the ends of said binder to be cut and inwardly crimped.

* * * * *